US005521800A

United States Patent [19]

Pine et al.

[11] Patent Number: 5,521,800

[45] Date of Patent: May 28, 1996

[54] BOTTOM LIGHTING SYSTEM FOR USE WITH A CONVEYER SYSTEM

[75] Inventors: Jerrold S. Pine, Boca Raton; David H. Rubin; Fredrick J. Marquardt, both of Boynton Beach, all of Fla.

[73] Assignee: Motorola, Inc., Schaumburg, Ill.

[21] Appl. No.: 446,978

[22] Filed: May 22, 1995

Related U.S. Application Data

[63] Continuation of Ser. No. 100,239, Sep. 2, 1993, abandoned.

[51] Int. Cl.[6] ..... F21V 33/00

[52] U.S. Cl. ..... 362/97; 29/720; 29/721; 362/32; 362/253; 362/271; 362/285

[58] Field of Search ..... 29/720, 721; 362/33, 362/253, 427, 428, 450, 97, 220, 271, 272, 269, 285

[56] References Cited

U.S. PATENT DOCUMENTS 3,240,925 3/1966 Paschke et al. ..... 362/253 X
3,360,641 12/1967 Korte ..... 362/253 X
4,866,578 9/1989 Glenn et al. ..... 362/253 X
5,072,341 12/1991 Huang ..... 362/253 X

FOREIGN PATENT DOCUMENTS 5-191094 7/1993 Japan ..... 29/720

*Primary Examiner*—Joseph M. Gorski
*Attorney, Agent, or Firm*—James A. Lamb

[57] ABSTRACT

A lighting system for use in a conveyer system used for work piece assembly comprising a lifting means (285) having one or more transparent upper lifting members (260) for lifting the work piece (270) and a lighting means (230) positioned below the transparent members and rotatably coupled to the lifting means (285) by a rotating means. The lighting means rotatably extends when the lifting means (285) is raised, thereby providing illumination to the work piece (270), and rotatably retracts when the lifting means (285) is lowered.

10 Claims, 9 Drawing Sheets

BOTTOM LIGHTING SYSTEM FOR USE WITH A CONVEYER SYSTEM

This is a continuation of application Ser. No. 08/100239 filed on Sept. 2, 1993 and now abandoned.

FIELD OF THE INVENTION

This invention relates in general to lighting systems and in particular to a bottom lighting system for illuminating a work piece on a conveyer system.

BACKGROUND OF THE INVENTION

Because of the demand for smaller yet more complex electronic devices, the parts used in their fabrication have become smaller and the spacing of the attachment leads on the parts has also become smaller. To achieve the quality levels and throughput required to be a successful competitor in the marketplace for such devices, robotic assembly techniques are essential. The small spacing between attachment leads encountered with the smaller, more complex parts necessitates the use of vision control for the robotic systems to achieve the higher accuracy of placement of the parts required to achieve good yields at the soldering stage of circuits boards. The use of fiducial marks specific and adjacent to the locations of critical parts on the circuit boards is a method commonly used in conjunction with vision systems to achieve the required highly accurate horizontal placement position.

One approach to creating and reading fiduciary marks is to generate them with plating patterns on the top surface of a circuit board and use light reflecting into the vision system camera (mounted above the board) from a light source mounted above the circuit board. This approach has some drawbacks, the most significant of which is that the accurate reading of the mark generally requires a smooth, flat surface on the fiduciary mark formed from a material such as gold. When tin plating is used, the accuracy typically degrades because of the lower reflectivity and higher dispersion of the reflected light due to the unevenness of the surface.

An alternative approach is to use a light source located beneath the board, relying on the translucent nature of printed circuit board material, and then to design the vision system to analyze the shadow of the fiduciary mark. Because the edges of the shadow are quite sharp this can produce even better accuracy than that obtained with the top lit approach, when the light is directed perpendicularly to the plane of the board.

A problem in using the bottom lit approach occurs in assembly lines that use conveyer systems which employ belts to convey the circuit boards from station to station. In this system, when the board reaches an assembly station, it is typically lifted a small distance off the moving belts and held in a fixed position during an assembly stage. When a fixed bottom lighting system is used, fiduciary marks that are located over the belts will be illuminated only by light that is at an acute angle and diminished in brightness, both of which reduce the ability of the placement system to identify the fiduciary mark accurately. This leads to restrictive design rules concerning the locations on the circuit board where parts requiring high placement accuracy may be placed, generally leading to the undesirable result of larger boards and longer design times.

Thus, what is needed is a simple, reliable means of providing a light source in the small space that is created between the conveyer belt and the circuit board by lifting the circuit board in preparation for parts placement, and which will illuminate near the edges of the board as effectively as in the center of the board with a light source that is generally perpendicular to the board.

SUMMARY OF THE INVENTION

An aspect of the present invention is a lighting system for use in a conveyer system used for assembling a work piece. The lighting system comprises a lifting element for lifting the work piece, and a lighting element, positioned below a transparent member of the lifting element, for illuminating the work piece. The lighting system further comprises a rotating element for coupling the lighting element to the lifting element. The lighting element rotatably extends when the lifting element is raised, thereby providing illumination to the work piece, and rotatably retracts when the lifting element is lowered.

Another aspect of the present invention is a lighting system for use in a conveyer system used for assembling a work piece. The lighting system comprises a lifting mechanism including a lifting plate for lifting the work piece from a carrying mechanism of the conveyor system. The lifting plate is horizontally oriented, and substantially transparent. The lighting system further comprises a drive rod which has a vertically oriented drive axis and is coupled to the lifting plate. The drive rod raises and lowers the lifting plate in the direction of the drive axis. The lighting system also includes a light positioned below the lifting plate for illuminating the work piece through the lifting plate, the light being rotatably coupled to the drive rod. The light rotatably extends with respect to the drive axis towards a horizontal position in response to a rising of the drive rod, and rotatably retracts with respect to the drive axis towards a vertical position in response to a lowering of the lifting mechanism.

DETAILED DESCRIPTION OF THE INVENTION

Figure 1:
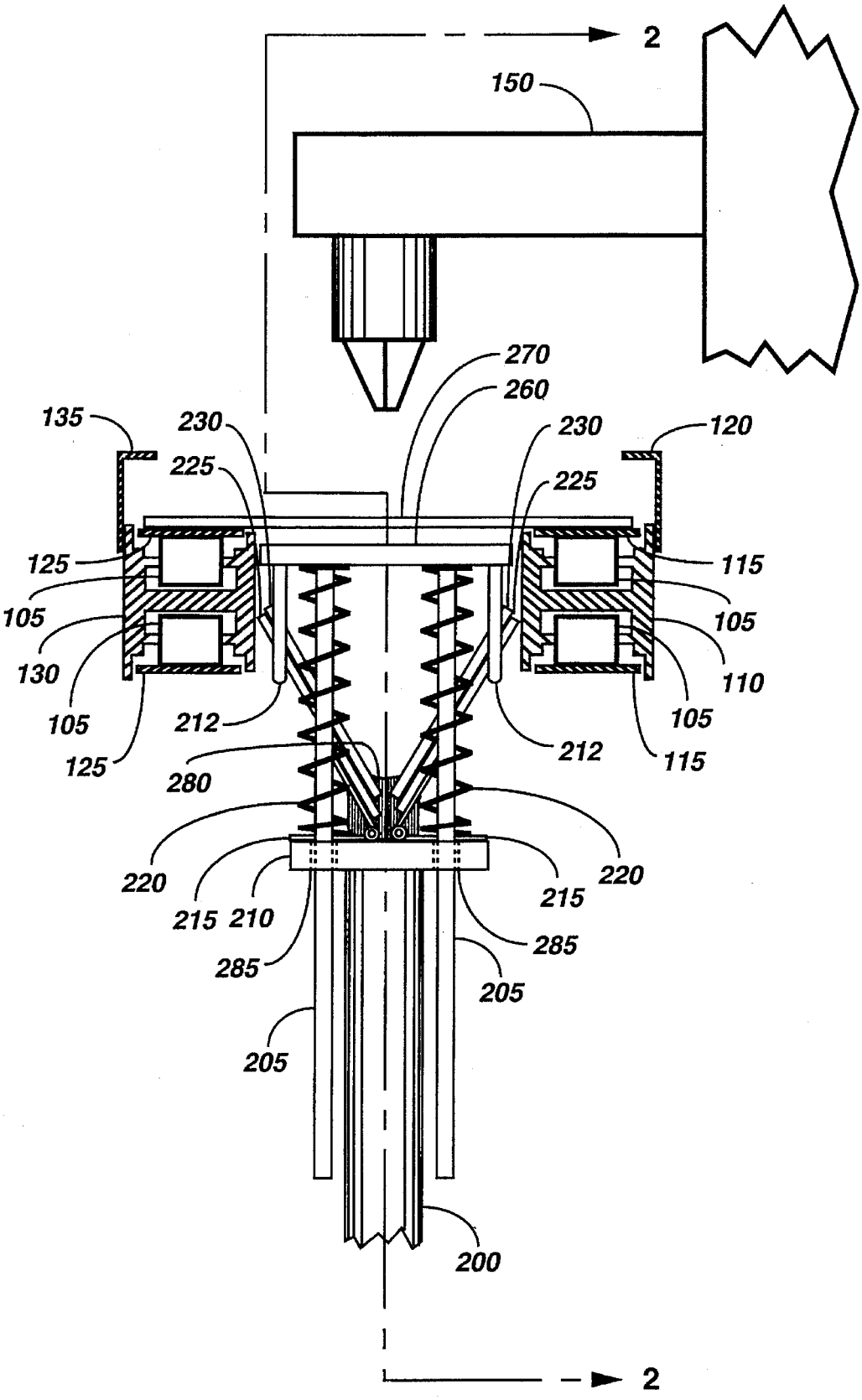
FIG. 1 is a mechanical diagram of an end view of a bottom lighting system shown in the lowest position, in accordance with the preferred embodiment of the present invention.
Figure 2:
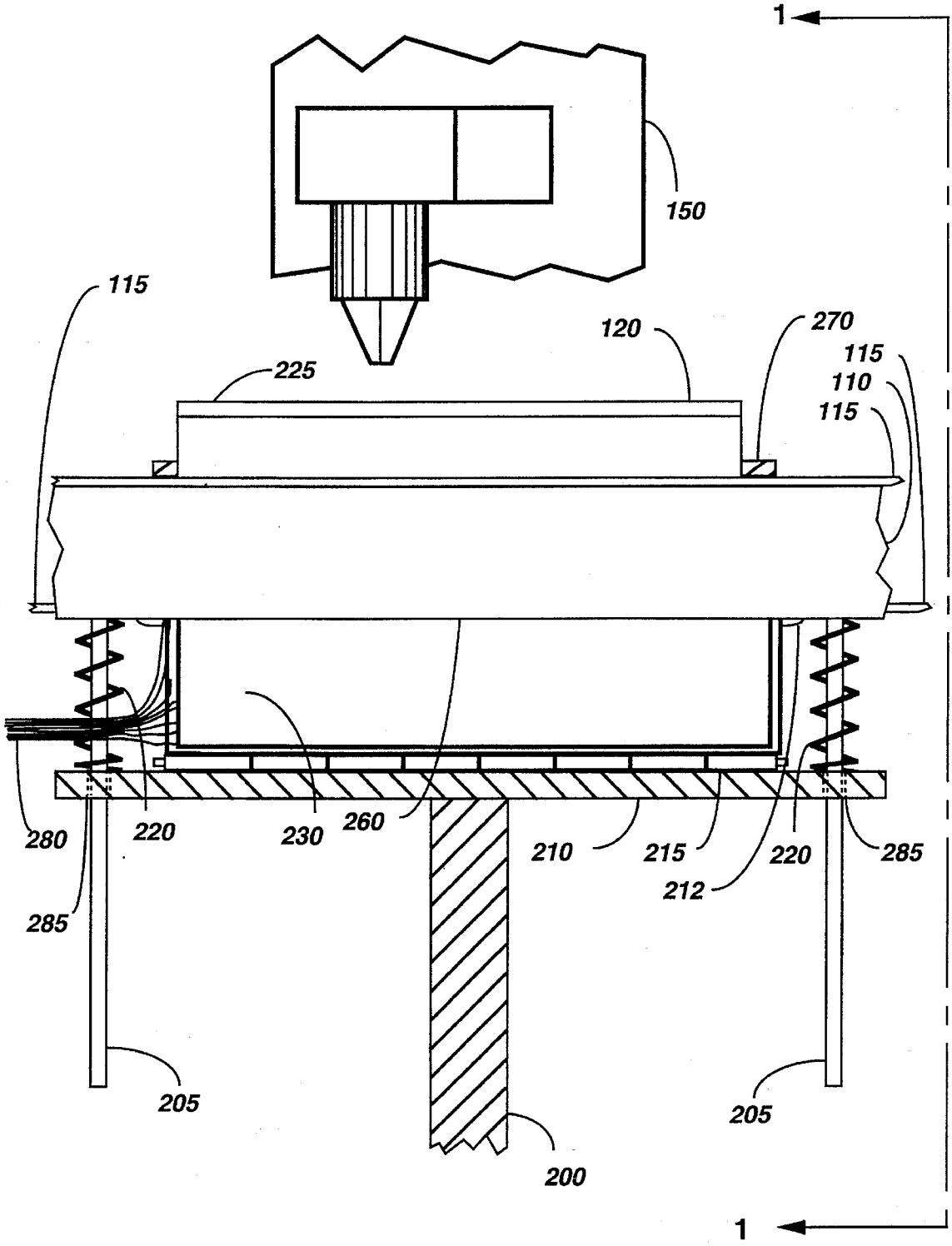
FIG. 2 is a mechanical diagram of a side view of the bottom lighting system shown in its lowest position, in accordance with the preferred embodiment of the present invention.

Referring to FIG. 1 and FIG. 2, a conveyer assembly, a portion of robotic placement machine 150, a circuit board raising and lighting assembly, and a circuit board 270 are shown in accordance with the preferred embodiment of the present invention.

The conveyer assembly comprises a front conveyer rail 130, a rear conveyer rail 110, a multiplicity of rollers 105, a front board stop 135, a rear board stop 120, a front conveyer belt 125 and a rear conveyer belt 115. In the end view shown in FIG. 1, the front and rear conveyer rails 130 and 110, four rollers 105, the two board stops 135 and 120, the upper and lower portions of both the front belt 125 and rear belt 115 are visible. In the side view shown in FIG. 2, the rear conveyer rail 110, the rear board stop 120, and the upper and lower portions of the rear belt 115 are visible. The front and rear rails 130 and 110 are held parallel to each other, at the same height above a floor. The front and rear board stops 135 and 120 are attached to the respective front and rear rails 130 and 110, directly opposite each other. The rollers 105 are mounted within and coupled to the rails 130 and 110 in a manner allowing them rotate freely. The tops of the belts 125 and 115 are driven on the rollers in the same direction in a manner common in the art, with the bottoms of the belts 125 and 115 following in the opposite direction, underneath the bottoms of the rollers, thereby conveying the circuit board 270 to placement stations when the circuit board 270 is resting on the belts. A portion of the robotic placement machine 150 including a robotic placement arm is shown above the conveyer assembly in FIG. 1 and FIG. 2.

As shown in FIG. 1 and FIG. 2, beneath the conveyer assembly is the circuit board raising and lighting assembly comprising a vertical drive rod 200, a flat rectangular drive plate 210, four vertical guide rods 205 (two of which are shown), four pressure springs 220 (two of which are shown), a flat rectangular transparent lifting plate 260, two horizontal guide rods 212, two hinges 215, two flat rectangular mounting plates 225 coupled to the hinges 215, two rectangular fiat light sources 230 and a lighting cable 280. The drive rod is mounted vertically with its axis centered between the rails 130 and 110, and in line with the centers of the board stops 135 and 120. The drive plate 210 is secured to the top end of the drive rod 200, centered to the axis of the drive rod 200, with the flat of the drive plate 210 parallel to the floor. A first axis of the drive plate 210 is centered horizontally between, and is parallel to, the conveyer rails 130 and 110. The transparent lifting plate 260 is parallel to and above the drive plate 210. The vertical guide rods 205 are perpendicular to the lifting plate 260 and the upper ends of the guide rods 205 are secured to the lifting plate 260 and extend through guiding clearance holes 285 in the drive plate 210. One of the four pressure springs 220 surrounds each guide rod 205 between the lifting plate 260 and the drive plate 210. The two horizontal guide rods 212 are rods bent into a U shape with two parallel equal length (leg) portions and a third portion perpendicular to the two. The leg portions of each horizontal guide rod 212 are secured perpendicularly to the lifting plate 260, with the axis of the third portion of the guide rod 212 parallel to the first axis of the drive plate 210.

The circuit board raising and lighting assembly further comprises two hinged light assemblies, each comprising one of the two hinges 215, one of the two flat rectangular mounting plates 225, and one of the two flat light sources 230. A first hinge plate of the hinge 215 is secured to the drive plate 210 such that the hinge pin is parallel to and near the first axis of the drive plate 210. The flat rectangular mounting plate 225 is secured to the second hinge plate of the hinge, with an edge parallel to and near the pin of the hinge 215. The flat light source 230 is secured to the mounting plate 225 by a double sided adhesive tape between the fiat areas of the mounting plate 225 and flat light source 230. The separation between the hinge pin side of the hinge plates of the hinged light assemblies is such that no part of the hinged light assembly will touch the opposite hinged light assembly when the upper edges of the mounting plates 225 are resting on the horizontal guide rods 212, as depicted in FIG. 1 and FIG. 2, when the drive rod is in a low position. The minimum distance in the direction of the first axis of the drive plate 210 between the pairs of springs 220 at each end of the drive plate 210 exceeds the dimension of the light assemblies 230, mounting plates 225, and hinges 215 in the same direction, thereby avoiding interference between the springs 220 and the hinged light assemblies. Similarly, the minimum length of the third portion of the horizontal guide rod exceeds the dimension of the light assemblies 230, mounting plates 225, and hinges 215 in the same direction, thereby avoiding interference between the hinged light assembly and the legs of the guide rods 212. The lighting cable 280 is attached to both flat light sources along one edge and is bound into a flexible bundle passing between the pressure springs 280 at end of the drive plate 210.

In the lowered position, when the circuit board 270 has been conveyed to a position directly under the stops 135 and 120, as shown in FIG. 2, there is clearance between the top of the lifting plate 260 and the bottom of the circuit board 270, and the bottom surface of the mounting plates 225 are resting on the guide rods, held there by their weight, with some clearance between the edges of the guide plates 225 and the conveyer rails 130 and 110.

Figure 3:
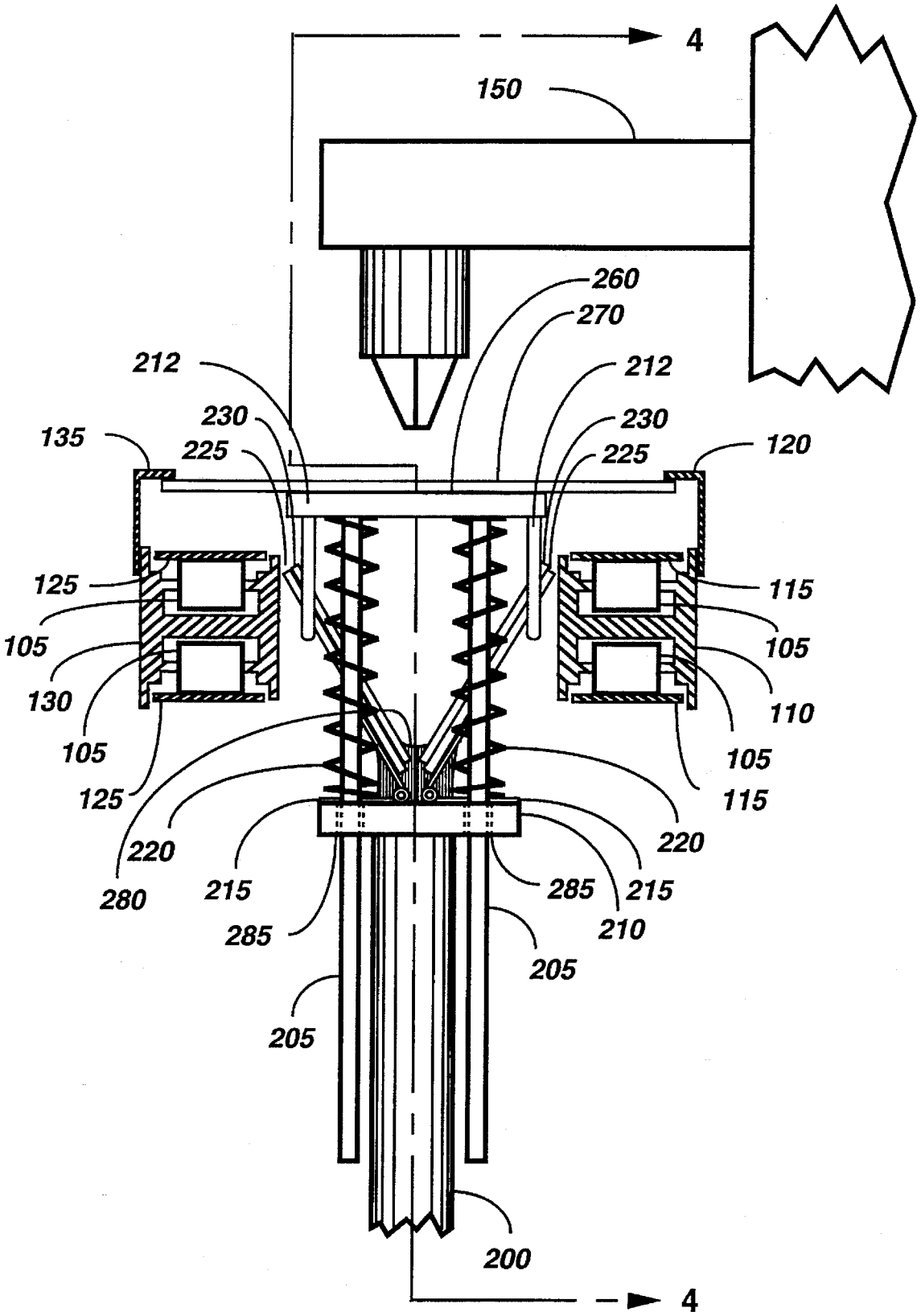
FIG. 3 is a mechanical diagram of the end view of the bottom lighting system shown in a second position, in accordance with the preferred embodiment of the present invention.
Figure 4:
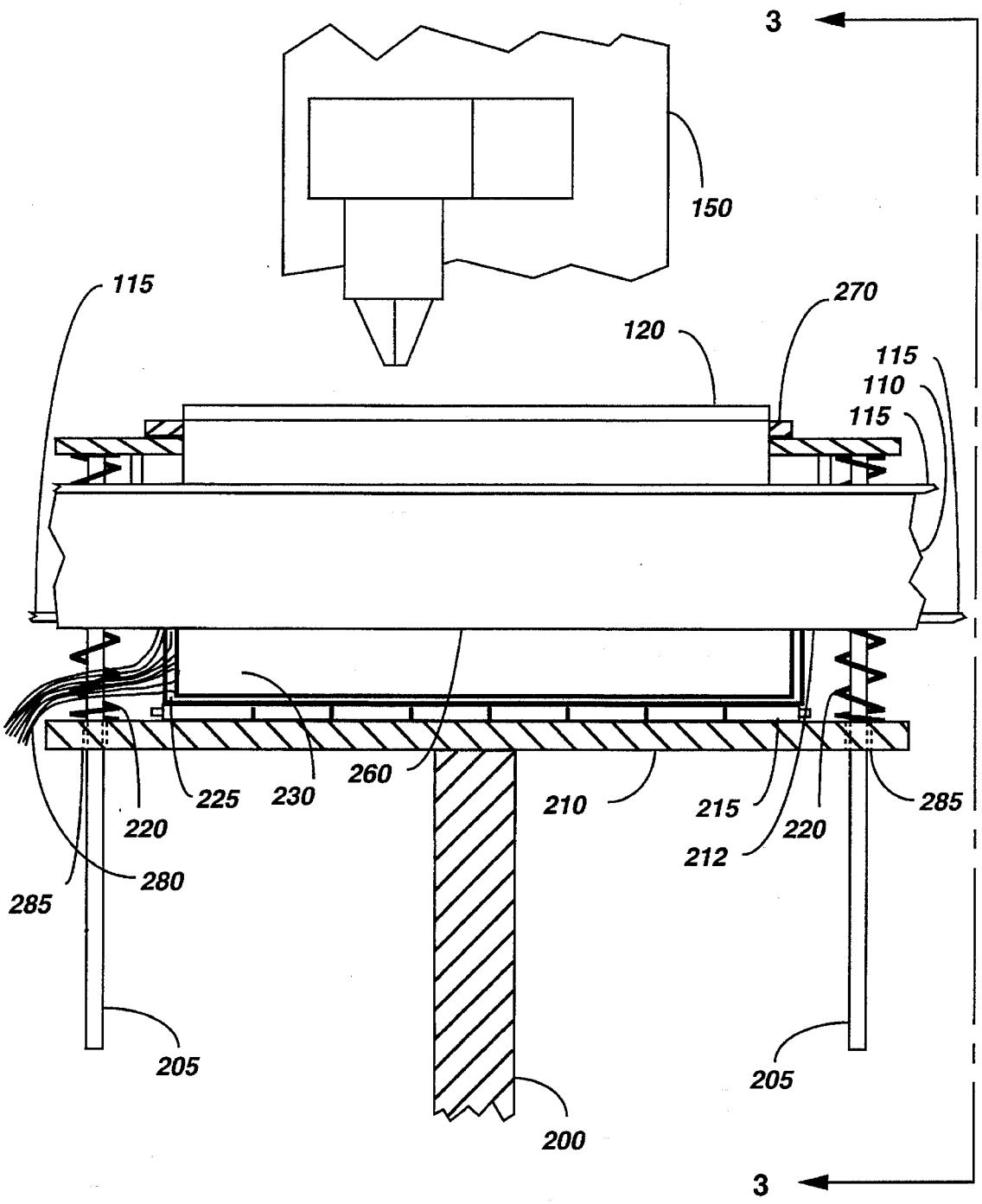
FIG. 4 is a mechanical diagram of the side view of the bottom lighting system shown in the second position, in accordance with the preferred embodiment of the present invention.

When the board reaches the position depicted in FIG. 2, the drive rod 200 begins to rise. As the drive rod 200 rises, the lifting plate 260 engages and lifts the circuit board 270 from the conveyer belts 125 and 115, until the circuit board 270 is stopped by the board stops 135 and 120. The position of the drive rod 200 and the items coupled thereto at the time when the circuit board 270 is stopped is shown in FIG. 3 and FIG. 4, which are respective end and side views, of the same items shown in FIG. 1 and FIG. 2, in accordance with the preferred embodiment of the present invention. The bottom surface of-the mounting plates 225 remain in the same position with respect to the horizontal guide rods 212.

Figure 5:
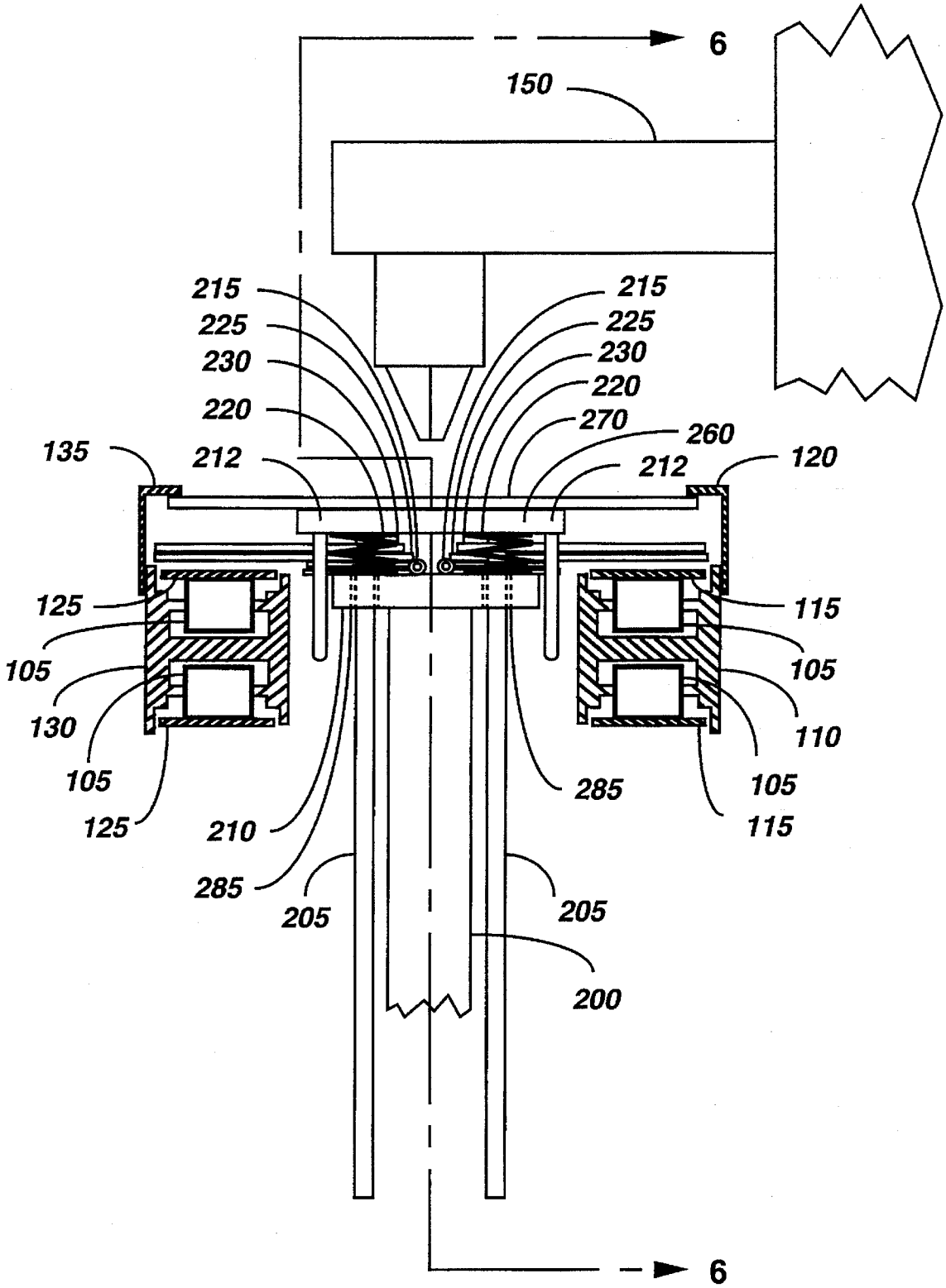
FIG. 5 is a mechanical diagram of the end view of the bottom lighting system shown in the highest position, in accordance with the preferred embodiment of the present invention.
Figure 6:
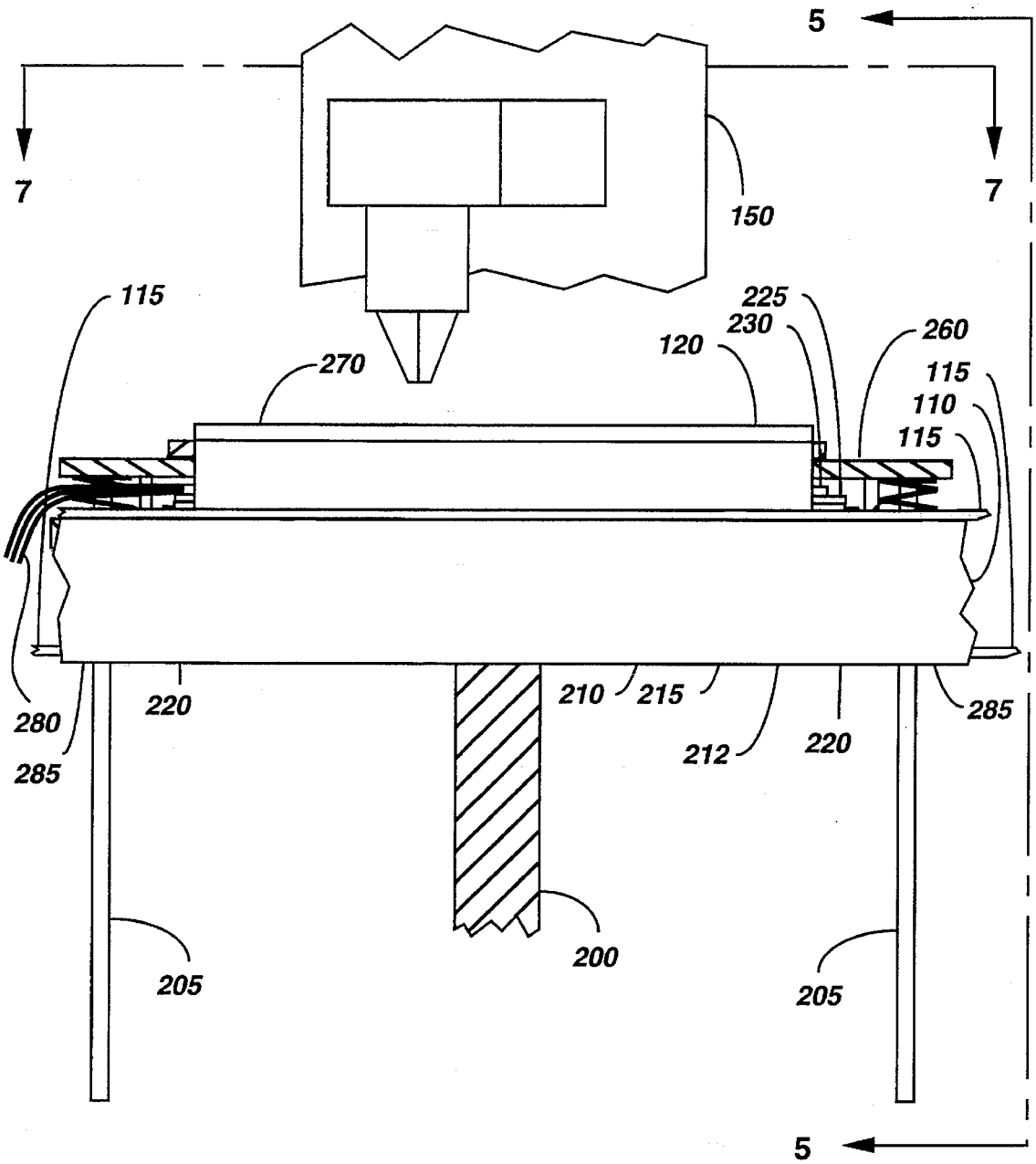
FIG. 6 is a mechanical diagram of the side view of the bottom lighting system shown in the highest position, in accordance with the preferred embodiment of the present invention.

As the drive rod 200 continues to rise, the springs 220 are compressed, putting increasing pressure on the circuit board 270 through the lifting plate 260. As the distance between the drive plate 210 and the lift plate 260 decreases, the mounting plates 225 begin to ride upon the third portion of the horizontal guide rods 212, on the under surfaces of the mounting plates 225. The mounting plates 225 begin to spread apart, due to their weight. When the drive rod 200 reaches an upper position, the mounting plates 225 have lowered to a substantially horizontal position, with a portion of the mounting plates 225 and flat light sources 230 above the drive belts 125 and 115. The position of the drive rod 200 and the items coupled thereto at the time when the mounting plates 225 are fully spread is shown in FIG. 5 and FIG. 6, which are respective end and side views, of the same items shown in FIG. 1 and FIG. 2, in accordance with the preferred embodiment of the present invention.

It should be appreciated that the location of the axis of the third portion of the horizontal guide rod and the separation between the drive plate 210 and lifting plate 260 before lifting is started, during lifting, and when lifting is completed, are calculated to cause the rotation of the hinged light assembly in such a manner as to avoid interference between the lifting plate 260 or the bottom of the circuit board 270, or any portion of the conveyer rails 130 and 110.

Figure 7:
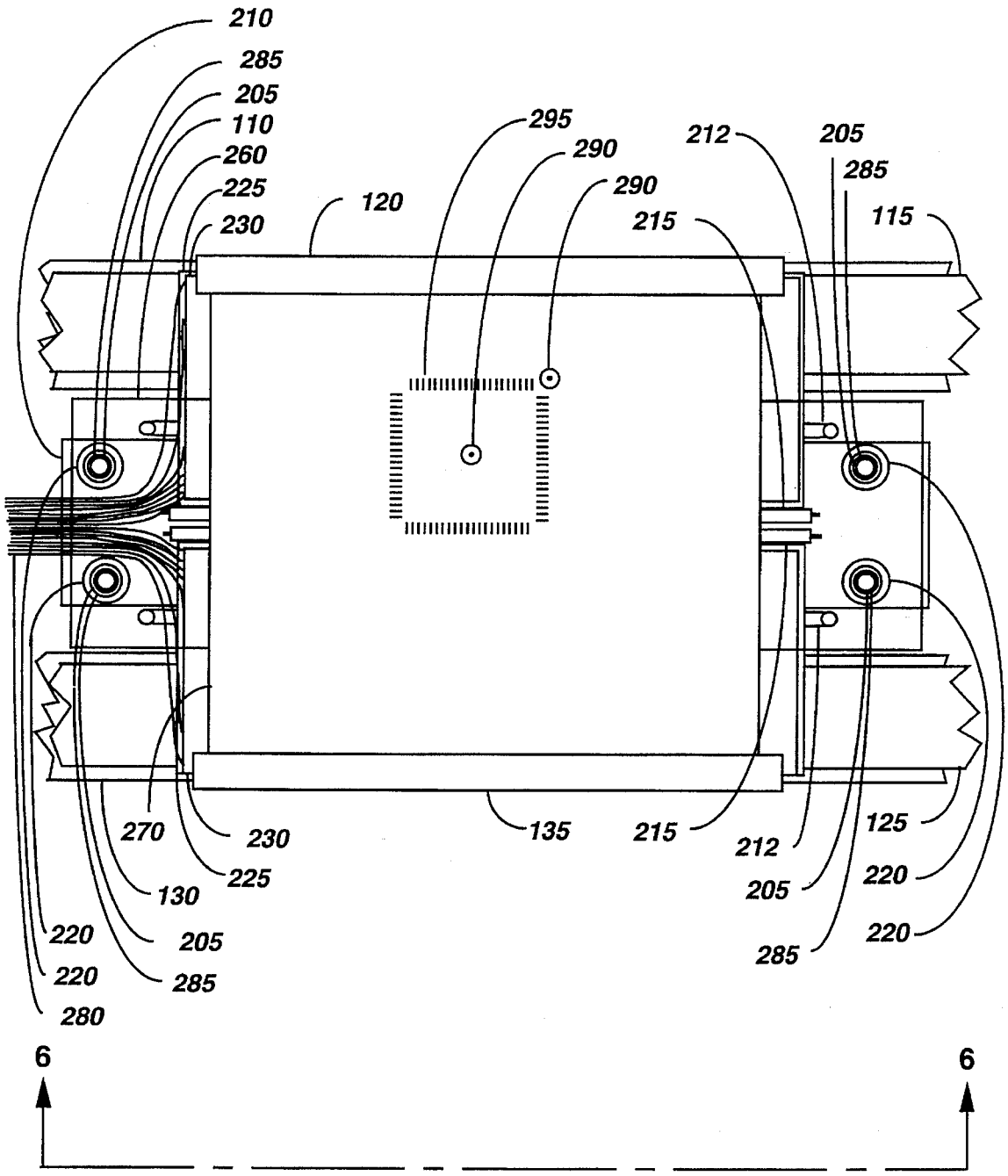
FIG. 7 is a mechanical diagram of a top view of the bottom lighting system shown in the highest position, in accordance with the preferred embodiment of the present invention.

Referring to FIG. 7, a top view of the conveyer, the circuit board raising and lighting assembly, and the circuit board in accordance with the preferred embodiment of the present invention is shown. The visible components of the conveyer assembly are the front rail 130, the rear rail 110, the tops of the front belt 125 and rear belt 115, the front board stop 135, the rear board stop 120, the hinges 215, the mounting plates 225, the flat light sources 230, the lighting cable 280, the drive plate 210, the transparent lifting plate 260, the circuit board 270, and the guide rods 205 and springs 220 which are seen through the transparent lifting plate 260. An electronic part attachment pattern 295 is shown on the PC board. Associated with the attachment pattern 295 are two fiducial marks 290 with opaque material removed from around the marks so the light can shine through the circuit board 270.

When the assembly activity is completed to the circuit board 270, the process depicted in FIG. 1 through FIG. 7 is reversed, the drive rod 200 moving back down to the lowered position. The mounting plates 225 ride on the horizontal guide rods 212 into the more vertical position shown in FIG. 2 and FIG. 4, and the circuit board disengages from the board stops 135 and 120. When the drive rod is near the bottom position, the circuit board 270 disengages from the lifting plate 260 and re-engages to the conveyer belts 125 and 115.

Each of the two flat light sources 230 is a fiber optic bundle shaped into a thin, flat assembly providing a uniform light source substantially perpendicular to the mounting plate. The fibers are bundled into the cable 280 at one end of the lighting assemblies, and routed to a fiber optic light source.

It should be appreciated that the light source used for the flat light source 230 could be incandescent, electroluminescent, light emitting diodes, or other light sources of appropriate color, intensity, reliability, and power. Variations in the mechanics coupling the drive plate to the lifting plate would be appropriate to accommodate variations in the drive rod or in drive plates already available in an existing conveyer system. The present invention can be used equally well with conveyer systems of other types, such as a conveyer system that comprises slides in place of the rollers 105. Also, there can be situations wherein the dimensions of the conveyer system and lifting mechanism are such that the mounting plates 225 of the hinged light assembly are better guided by structures secured to the conveyer rails or other portions of the conveyer system instead of the lifting plate 260.

Figure 8:
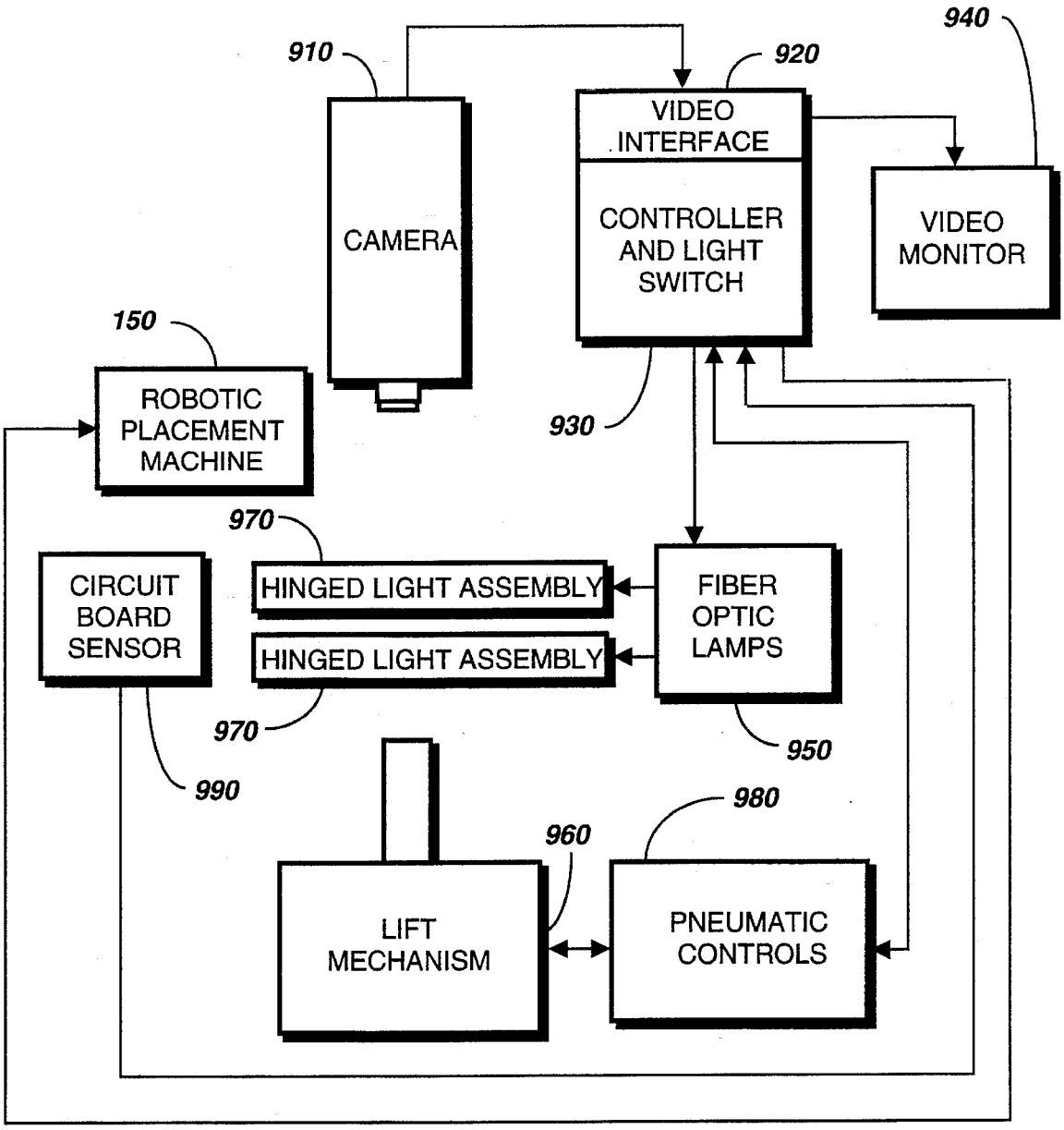
FIG. 8 is an electromechanical block diagram of the bottom lighting system in accordance with the preferred embodiment of the present invention.

Referring to FIG. 8, an electromechanical block diagram of the bottom lighting system, in accordance with the preferred embodiment of the present invention is shown, comprising a camera 910 coupled to an input of a video interface card 920 which is mounted in the chassis of, and coupled to, a controller 930, a video monitor 940 coupled to an output of the video interface card 920, a circuit board sensor 990 coupled to a first output of the controller 930, a pneumatic control 950 coupled bidirectionally to the controller 930, a switched fiber optic lamp assembly 950 coupled to a second output of the controller 930, two hinged light assemblies 970 coupled to outputs of the switched fiber optic lamp assembly 950, a robotic placement machine 150 coupled to a third output of the controller 930, and a lift mechanism 960 coupled bidirectionally to the pneumatic control 980. The circuit board sensor 990 is an optical sensor of a type well known in the art which is used to detect the arrival of the circuit board 170 at the placement station. The camera 910 is used to visualize the circuit board 170 so that the position of a component to be placed is identified. In the preferred embodiment of the present invention a closed circuit television (CCTV) camera such as model TM840 CCTV camera manufactured by PULNiX America, Inc. of Sunnyvale, Calif. is used. The video interface card 920 processes the video output from the camera 910. In the preferred embodiment of the present invention a video interface card such as a MaxVideo™ video interface card manufactured by Datacube of Danvers, Mass. is used. The controller 930 is preferably a model 1167 VME chassis manufactured by Motorola of Schaumburg, Ill. The robotic placement machine 150 places parts onto the circuit board 270. The robotic placement machine 150 is preferably a model Seiko XM5104 Robot manufactured by Seiko Instruments U.S.A. of Torrence, Calif. The video monitor 940 is a color monitor such as model CPD-13045 manufactured by SONY Corporation of America, of Paramus, N.J. The switched fiber optic lamp assembly 950 is used to illuminate the flat light sources 530 and is preferably a fiber optic lamp assembly model L586 manufactured by Fiber Optics Specialties of Ellenton, Fla. The pneumatic control 980 and the lift mechanism 960 are used to lift and lower the circuit board 270 and comprise pneumatic devices which are well known in the art. The hinged light assemblies 970 comprise flat light sources 530 such as manufactured by Lumitex of North Royalton, Ohio. It will be appreciated that other components can be substituted for the various elements described above.

It should also be appreciated that in the situation where fiducial marks are used in a restricted area of a circuit board, the appropriate number of hinged light assemblies 970 can be one. Other situations can require more than two.

Figure 9:
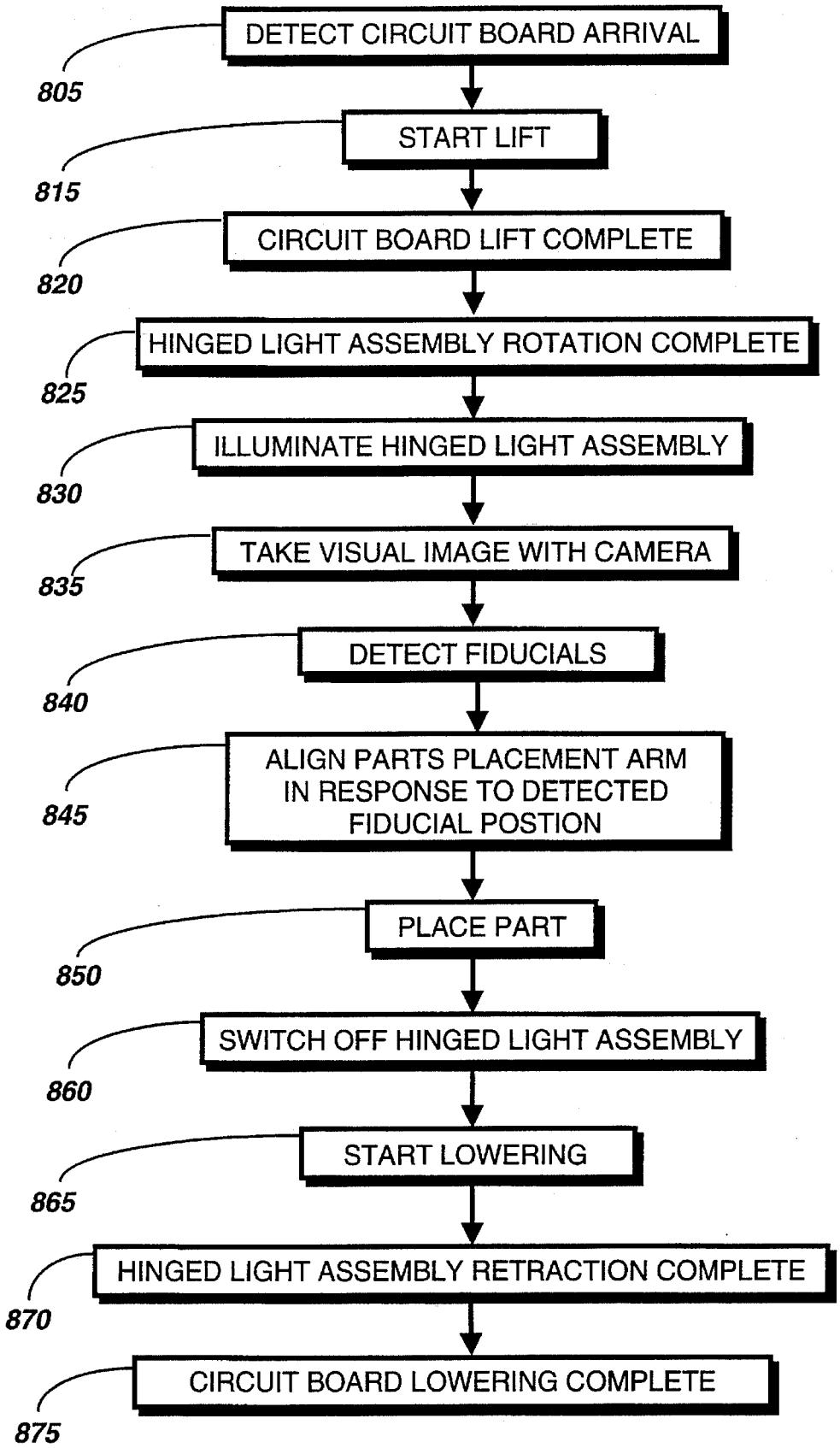
FIG. 9 is a flow chart illustrating the operation of the bottom lighting system in accordance with the preferred embodiment of the present invention.

Referring now to FIG. 9, a flow chart of the process steps of the bottom lighting system, in accordance with the preferred embodiment of the present invention is shown. The process steps will be described with reference to FIG. 9 and the figures described above.

With the lift mechanism in the lowered position of FIG. 1 and FIG. 2, the circuit board 270 is conveyed by the belts 125 and 115 to a position where an edge of the circuit board 270 is detected in the controller 920 by the output of sensor 990, in step 805 of FIG. 9. The controller signals the pneumatic control 980 to start the raising of the lift mechanism 960, in step 815. The circuit board lift is completed in step 820 when the circuit board 270 engages the circuit board stops 135 and 120. When the hinged light assemblies 970 are substantially horizontal the rotation is completed, in step 825. The switched fiber optic lamps are turned on in step 830 when the controller 930 receives a signal from the pneumatic control 980 indicating completion of lifting of the lift mechanism 960, and the camera 910 creates a digitized image of the area of the circuit board 270 containing fiducial marks 290 in step 835. The output of the camera is processed by the controller 930 to locate the fiducial marks 290 on the circuit board 270 in step 840. In step 845, the controller aligns the placement arm of the robotic placement machine 150 in response to the detected fiducial position, and controls the robotic machine to place a part onto the circuit board 270 in step 850. When the parts placement is complete the switched fiber optic lamps are turned off in step 830. The controller 920 then signals the pneumatic control 980 to begin the lowering of the lift mechanism 960 in step 865. When the drive plate 210 lowers sufficiently, the lifting plate 260 and circuit board 270 start lowering, and the rotation hinged light assembly rotation back to the more vertical position is completed in step 870. The circuit board 270 lowering is completed in step 875 when the circuit board engages with the conveyer belts 125 and 115. By now it should be appreciated that the unique addition of the rotating flat light sources 230 to the conveyer system provides lighting of uniform brightness out to the edges of the circuit board 270 except where the circuit board 270 is masked by the stops 135 and 120. The light is also substantially perpendicular to the circuit board, permitting highly accurate vision reading of fiducial marks on the work piece, which in the present instance is a circuit board.

We claim:

1. A lighting system for use in a conveyer system used for assembling a work piece, comprising:

lifting means for lifting the work piece;

lighting means, positioned below a transparent member of said lifting means, for illuminating the work piece; and rotating means for coupling said lighting means to said lifting means; and wherein said lighting means rotatably extends when said lifting means is raised, thereby providing illumination to said work piece, and rotatably retracts when said lifting means is lowered.

2. The lighting system in accordance with claim 1 wherein said lighting means is rotated towards a horizontal position substantially parallel to the work piece when rotatably extended and is rotated towards a vertical position when rotatably retracted.

3. The lighting system in accordance with claim 1, further comprising a guide member for guiding said lighting means when said lifting means is raised and lowered.

4. The lighting system in accordance with claim 1, further comprising a camera means for visualizing a fiducial marking on the work piece which is illuminated by said lighting means when said lifting means is raised.

5. The lighting system in accordance with claim 1 comprising a controller for switching power to said lighting means when said lighting means rotatably extends.

6. A lighting system for use in a conveyer system used for assembling a work piece, comprising:

a lifting mechanism comprising:

a lifting plate for lifting the work piece from a carrying mechanism of the conveyor system, wherein said lifting plate is horizontally oriented, and substantially transparent, and a drive rod which has a vertically oriented drive axis and is coupled to said lifting plate, wherein said drive rod raises and lowers said lifting plate in the direction of the drive axis; and a light positioned below said lifting plate for illuminating the work piece through said lifting plate, wherein said light is rotatably coupled to said drive rod, wherein said light rotatably extends with respect to said drive axis towards a horizontal position in response to a rising of said drive rod, and rotatably retracts with respect to said drive axis towards a vertical position in response to a lowering of said lifting mechanism.

7. The lighting system in accordance with claim 6, wherein said lifting plate is slidably coupled to the drive rod along the drive axis, and wherein the lifting mechanism further comprises at least one guide member fixed to said drive rod and slidably coupled to said light for guiding said light to rotatably extend in response to at least a portion of the rising of said lifting mechanism.

8. The lighting system in accordance with claim 6, wherein the light comprises two lamps having substantially flat emission areas for providing substantially uniform lighting in a vertical direction through the lifting plate when said drive rod is in a fully raised position and said lamps are in a substantially horizontal position, wherein said drive rod is rotatably coupled to each lamp.

9. The lighting system in accordance with claim 6, wherein the light comprises:

a flat plate for extending into a narrow vertical space existing between the carrying mechanism and the lifting plate when the drive rod is in a fully raised position and the work piece has been lifted above the work piece carrying mechanism by the lifting plate; and a flat fiber optic bundle affixed to the flat plate and shaped to provide a substantially uniform beam of light perpendicular to said flat plate.

10. The lighting system in accordance with claim 6, wherein said lifting plate is slidably coupled to the drive rod along the drive axis, and wherein said light is slidably coupled to a bottom surface of said lifting plate for guiding said light to rotatably extend in response to at least a portion of the rising of said lifting mechanism.

* * * * *